United States Patent [19]

Higgs

[11] 4,033,002

[45] July 5, 1977

[54] LIFE SAVING EQUIPMENT FOR VESSELS

[75] Inventor: William York Higgs, Gibsons, Canada

[73] Assignee: Intercontinental Marine Limited, Vancouver, Canada

[22] Filed: Jan. 16, 1976

[21] Appl. No.: 649,788

Related U.S. Application Data

[63] Continuation-in-part of Ser. No. 471,964, May 21, 1974, abandoned.

[30] Foreign Application Priority Data

May 21, 1973 United Kingdom ..... 24113/73

[52] U.S. Cl. ..... 9/14; 9/9; 9/11 A

[51] Int. Cl.[2] ..... B63C 9/22

[58] Field of Search ..... 9/11 R, 11 A, 14, 8 R, 9/8.3 R, 8.3 E, 9, 3, 1.3

[56] References Cited

UNITED STATES PATENTS

| | | | |
|---|---|---|---|
| 2,888,690 | 6/1959 | Shaw | 9/11 A |
| 2,968,820 | 1/1961 | Pritty | 9/11 R |
| 3,618,150 | 11/1971 | Anselmi | 9/8.3 E |
| 3,765,041 | 10/1973 | Morse | 9/6 P |

*Primary Examiner*—Trygve M. Blix
*Assistant Examiner*—Sherman D. Basinger
*Attorney, Agent, or Firm*—Stevens, Davis, Miller & Mosher

[57] ABSTRACT

Lifesaving apparatus for vessels in the form of a buoy releaseably carried by a vessel in a manner so as to float free if the vessel sinks while remaining attached to the vessel by a cable held on a reel on the buoy and having its outer end connected to the vessel. The buoy carries at least one inflatable life raft held in deflated condition in an enclosure which is formed in part by a recess on the buoy body and in part by a cover removably sealed around the recess, the seal being rupturable on inflation of the life raft and the recess being so formed as to allow the life raft to expel itself from the recess during its inflation, the inflated raft then floating on the water while remaining attached to the buoy by its painter. The life raft is arranged to be automatically inflated after the buoy has separated from the vessel by a predetermined distance. The cover is attached to the buoy body in such a way that the top of the cover remains hingedly connected to the body when the life raft starts to leave the recess, so that the life raft is steadied and is unlikely to inflate inverted. A breakable cord connecting the bottom of the raft with the life raft recess also assists in preventing inverted inflation. A drainage hole is provided in the recess to drain off excess moisture from the life raft and from its recess. The buoy when floating with recesses open provides substantial sea-anchor effect.

29 Claims, 8 Drawing Figures

LIFE SAVING EQUIPMENT FOR VESSELS

Figure 2:
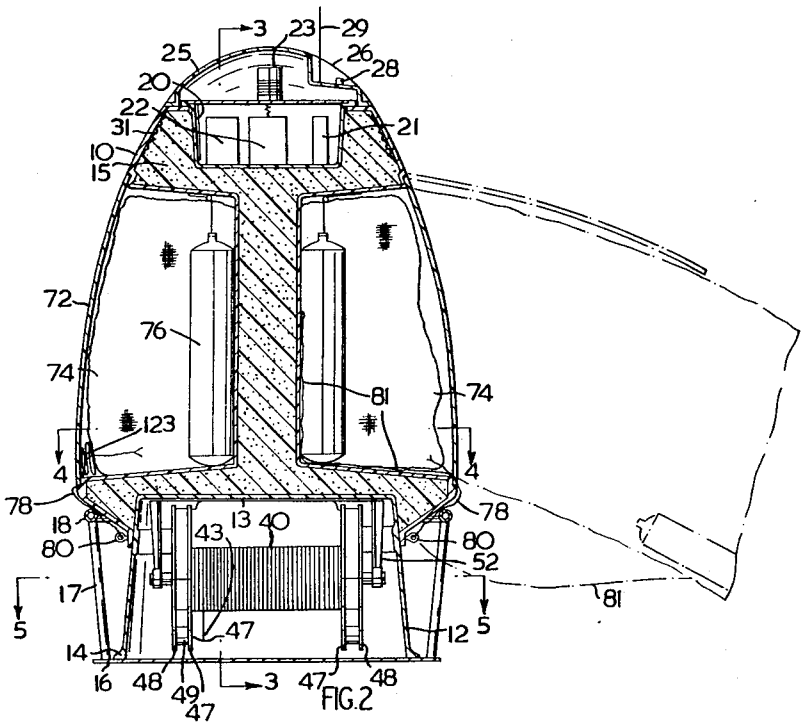

This application is a continuation-in-part of U.S. Ser. No. 471,964 filed May 21, 1974, now abandoned.

This invention relates to lifesaving apparatus for vessels, and particularly to improvements in the inventions described in my U.S. Pat. Nos. 3,703,736 (dated Nov. 28, 1972) and U.S. Pat. No. 3,905,060 (dated Sept. 16, 1975). These inventions are concerned with a buoy which is suitable for being carried by a vessel in a manner permitting release and flotation of the buoy should the vessel sink, said buoy including a body having sufficient buoyancy to cause the buoy and parts carried thereby to float free from the sinking vessel, a normally stowed cable of adequate strength to act as an anchor cable, the cable being connected with the buoy and for connection with the vessel so as to maintain connection between the floating buoy and the vessel after this has sunk. A buoy of this type will hereinafter be referred to as being "of the type described."

The buoys described in the aforesaid patents include both light and radio beacons which automatically give distress signals when the buoy is floating in the water. Also, a particular feature of U.S. Pat. No. 3,703,736 was the use of a buoyant life boat mooring line which is relatively long compared to the dimensions of the buoy and which is normally stowed on the buoy, but which is released automatically when the buoy separates from the vessel to stream out on the water and to provide mooring means for buoyant equipment such as life boats, life rafts, etc. released from the vessel. The buoyant equipment held in this way remains in marshalled condition in the vicinity of the sunken vessel and can easily be located by the beacons described, and this arrangement provides the further advantage that the buoyant equipment stays head-on to the wind and sea so that the risk of upset is minimized.

The buoys described in the aforesaid patents rely primarily for their lifesaving capability on the presence of buoyant equipment such as life boats and life rafts which would be released from the vessel before this sinks, although the buoy does provide hand loops which can be grasped by swimmers in the water, who can also hold onto the life boat mooring line. The present invention provides a buoy having additional lifesaving capabilities in that it also carries inflatable life raft means which are quite independent of any buoyant equipmemnt normally carried by the vessel, and which can support crew members or passengers even if for one reason or another the life boats or life rafts normally held by the vessel cannot be launched or cannot be properly utilized.

It has already been proposed in accordance with U.S. Pat. No. 3,618,150 to Anselmi, which issued Nov. 9, 1971, that a buoy of the general type described above can be provided with an inflatable life raft. In the Anselmi buoy, the life raft is held in a generally cylindrical casing forming part of the buoy, and an access door is provided normally held in place by bolts and wing nuts. It is proposed in accordance with the Anselmi patent that a survivor should swim to the buoy, remove the wing nuts holding the door, remove the life raft from the buoy, tie the life raft painter to the buoy, and then inflate this by means of pressurized gas stored with the life raft. Seemingly, the Anselmi design also requires quick replacement of the door to protect the electrical equipment inside the buoy casing. These operations are likely to be extremely difficult or impossible to perform in conditions of high wind and waves, and possibly darkness, which frequently accompany sinkings. The present invention provides lifesaving apparatus which is very much more practical, and which does not call for difficult operations to be performed by survivors.

In accordance with one aspect of the present invention, in lifesaving apparatus of the type described, the buoy includes a casing filled with rigid buoyant material imparting strength to the body of the buoy, said anchor cable being connected to a lower part of the buoy so that when the buoy is floating the weight of the cable and relative weights of the remaining parts of the buoy hold the buoy upright with the anchor cable extending from its lower end. The buoy body has at least one recess therein opening into that surface of the buoy which is at the side when the buoy is floating upright, said recess having outwardly sloping side surfaces and being surrounded by said rigid buoyant material which rigid material forms a solid structure connecting the upper and lower parts of the buoy above and below the recess, the recess being normally closed by a cover which forms an enclosure with the recess. An inflatable life raft is normally stowed in deflated condition in the enclosure together with a source of pressurized gas for inflating the life raft, this source of pressurized gas communicating with valve means controlling flow of gas into the life raft for its inflation, the valve means being operable by release means extending out of the enclosure. The cover of the recess is joined to the buoy body by holding means which are arranged so as to permit the life raft to dislodge the cover and to expel itself from the enclosure during its inflation, and the valve means are operable from outside the enclosure to cause the life raft to inflate and expel itself from the buoy.

With the buoys of this invention, there is no need for any manual extraction of the life raft. At a suitable opportunity, generally when the vessel has sunk sufficiently below the buoy to preclude any risk of entanglement of the life raft with the vessel rigging, the life raft is inflated either automatically, or manually by pulling a line attached to the buoy, and the life raft then breaks out of its enclosure, releasing the means holding the cover onto the enclosure, and soon afterwards the life raft is ready to be boarded, while remaining moored to the buoy.

Reference to "the life raft" will be understood as being reference to each life raft, where, as is preferred, several similar life rafts are carried.

The enclosure for the life raft, and particularly the outwardly diverging sides of the recess, may be contrasted with the enclosure used by Anselmi which occupies a large portion of the cylindrical central part of the buoy, and which includes a central column which may obstruct movement of the life raft, and to which access is gained by the door which occupies only perhaps a quarter of the perimeter of the buoy. An enclosure of Anselmi's configuration would not allow the life raft to expel itself on inflation, even if the wing nuts shown by Anselmi were replaced by some kind of rupturable seal.

In one type of buoy to be described, the release means may be suitable for automatically inflating the life raft after the buoy has left the vessel. Preferably, the automatic release means is provided by interconnecting means between the buoy and the vessel arranged to cause inflation of the life raft only after separation of the buoy from the vessel by a predetermined amount, to avoid any chance of entanglement of the life raft with the vessel structure. The means interconnecting the buoy and the vessel may include a normally stowed trip line, having an inner end connected with the valve means to cause release of the presurized gas into the life raft when pulled out to its full length, this trip line being arranged to be pulled from a stowed position when the buoy separates from the vessel and having its outer end connected to the vessel and having a stowed length sufficient to allow the vessel to sink until its rigging is submerged before the release means inflates the life raft.

The above-mentioned features of the buoy were described in the aforesaid application Ser. No. 471,964. The buoy described in this present application includes modifications whereby:

1. The well-known problem of inverted inflation of the inflatable life rafts is practically eliminated;

2. The common problem of deterioration due to "sweating" of a stowed inflatable life raft is overcome, and 3. The "sea-anchor" capability of the buoys is maximized.

Concerning (1); inflatable life rafts are commonly stored on the deck of a vessle in canisters having two semi-cylindrical portions which are held and sealed together by a rupturable seal. A line which may eventually serve as the life raft painter passes out of the canister, and is connected within the canister to valve means which allow gas to flow from a compressed gas cylinder into the life raft, inflating it and breaking apart the canister portions. These life rafts are operated by a crew man who holds onto the outer end of the line, or temporarily secures it to a suitable point, and then pushes the canister over the side of the vessel. After a certain amount of the line has been pulled out from the canister, the life raft inflates and releases itself from the canister portions. An arrangement of this type is shown for example in U.S. Pat. No. 2,968,820 to Pritty.

A well-known problem with canister arrangements of this kind is that the life raft often inflates inverted, and in weather conditions which usually accompany sinkings it is very difficult to turn the life raft over in the water. Although Pritty does show a stabilizing arrangement in which the relatively heavy gas cylinder is at the bottom of the canister, the shape of the canister means that there is in fact little resistance to rolling and it has been found this arrangement does not completely overcome the problem.

The buoy of this invention provides a suitable lanuching structure for the inflatable life raft. The anchor cable of the buoy is connected to a lower part of the buoy so that when the buoy is floating the weight of the cable and relative weights of remaining parts of the buoy hold the buoy upright with the anchor cable extending from its lower end, and the recess for the inflatable life raft opens into that surface of the buoy body which is at the side when the buoy is floating upright. This feature itself gives a much more stable life raft launching arrangement than known life raft canisters, greatly reducing the chance of inverted inflation.

According to a further aspect of the present invention, the proper inflation and launching of the inflated life rafts from the buoy is enhanced by the feature that the holding means connecting the cover of the buoy body have a strength distribution which ensures that an upper part thereof maintains a hinged connected between an upper part of the cover and the buoy body after the remainder of the holding means has been caused to release the remainder of the cover by initial inflation of the life raft. Also, the upper part of the holding means are such as to restrain outward pivoting of the cover about said connection during initial inflation of the life raft, so that the cover remains in contact with an upper part of the life raft and steadies the latter as it expels itself from the recess.

In practice, the required strength distribution may be achieved using marine self-adhesive tape as the holding means, the tape also sealing the outer margin of the cover to adjacent parts of the body, the tape being applied in a single thickness around a major, lower area of the cover and in a double thickness arond a minor, upper area of the cover.

Another way of achieving the required strength distribution is to provide straps extending horizontally across the door, attached to the buoy body at their ends. Two straps may be arranged at one-third and two-thirds the door height, with the upper strap being the stronger.

In accordance with another feature of the invention, a breakable cord may be provided connecting the lower part of the raft (i.e. the lower part when inflated) to the buoy body in the region of the bottom of the recess. This holds the raft in the proper orientation during at least its initial inflation, and then breaks.

Referring to problem (2) above, this concerns the fact that normally stowed inflatable life rafts frequently deteriorate due to the rotting effects of moisture when gathers in the life raft canisters. This moisture originates from the life raft itself and from the air within the canister coupled with temperature changes. The canisters are normally carried horizontally, leaving no natural sump from which the canisters may be drained. By contrast, the recess provided by the buoy of this invention is very suitable for drainage from a lower portion.

Thus, in accordance with another aspect of this invention, in a buoy of the type described, and having the anchor cable connected to a lower part of the buoy so that when the buoy is floating the weight of the cable and relative weights of the remaining parts of the buoy hold the buoy upright with the anchor cable extending from its lower end, and having a recess opening into that surface of the buoy which is at the side when the buoy is floating upright, said recess being normally closed by a cover to form an enclosure for an inflatable life raft, and having a life raft stowed in said enclosure; a drainage hole is provided leading from the lowest point of the life raft recess to the outside of the buoy.

Drainage is facilitated by the general shape of the recess which has a height considerably greater than the maximum width and about twice the maximum depth; and by a downwardly outwards slope on the bottom of the recess. This shape also ensures that any water remaining in the recess is not in contact with the life raft.

It may be noted that, unlike in the Anselmi design referred to above, there are no exposed electrical terminals within the recess such as could become affected by moisture either before or after removal of the cover.

Concerning (3); an important consideration in the design of buoys described herein is that they have a good "sea anchor" effect, i.e. they resist movement through the water of themselves and the buoyant equipment to which they are attached.

One feature of buoys of the type described in my aforesaid U.S. Pat. No. 3,905,060 is the provision of a reel for the anchoring cable, carried at the base of the buoy and surrounded by a skirt on which the buoy is normally supported on a vessel. The skirt provides turbulence when the buoy is pulled in the water giving good resistance to movement.

In accordance with a further aspect of this invention, the recesses used for housing the life rafts are additionally used, when empty, to provide further resistance to movement of the buoy in the water. For this purpose, the buoyancy of the buoy is designed to be such that when a life raft has been expelled from its recess, or in the case of a buoy carrying several life rafts where each such raft has been expelled from its recess, a substantial proportion of the recess is submerged. Preferably, the buoyancy is such that the major proportion, or substantially the whole, of each recess, is submerged.

The sea anchor effect is particularly important when sinkings occur in deep water, for example in ocean crossings, since the anchor cable cannot be used at such depths and is disconnected during such crossings. However, even where the anchor cable can be used, the sea anchor effect is important in holding the inflated life rafts head to wind, since the anchor cable will inevitably allow some drifting, for example with changes in wind direction, before becoming fully effective. The buoy must of course provide anchorage not only for the life rafts carried thereby, but for other buoyant equipment carried by the vessel.

The aforementioned Anselmi buoy does not incorporate this "sea-anchor" feature, since it is important in the Anselmi construction that the cover of his life raft recess be replaced after removal of the life raft to protect electrical equipment from water.

References above to "the life raft" will be understood as referring to each lift raft where, as is preferred, several similar life rafts are used.

Figure 1:
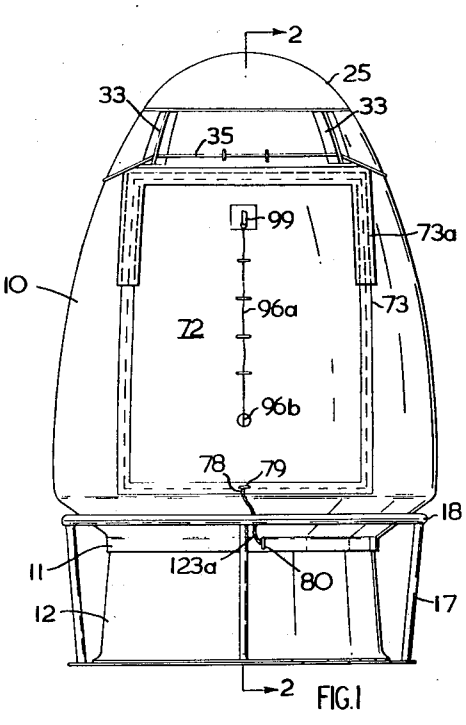
Figure 4:
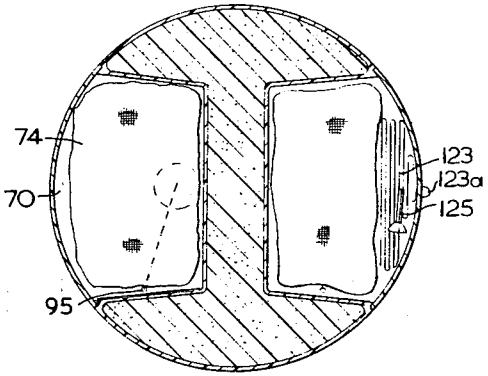
Figure 3:
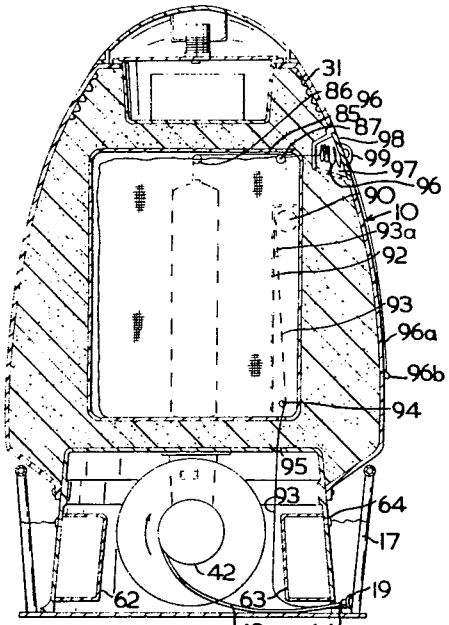
Figure 5:
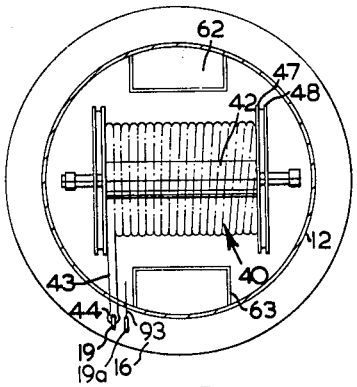
Figure 6:
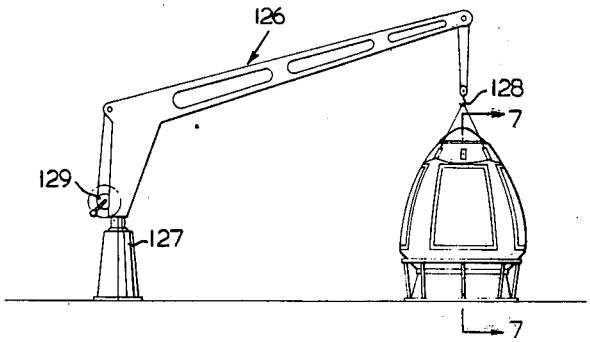
Figure 7:
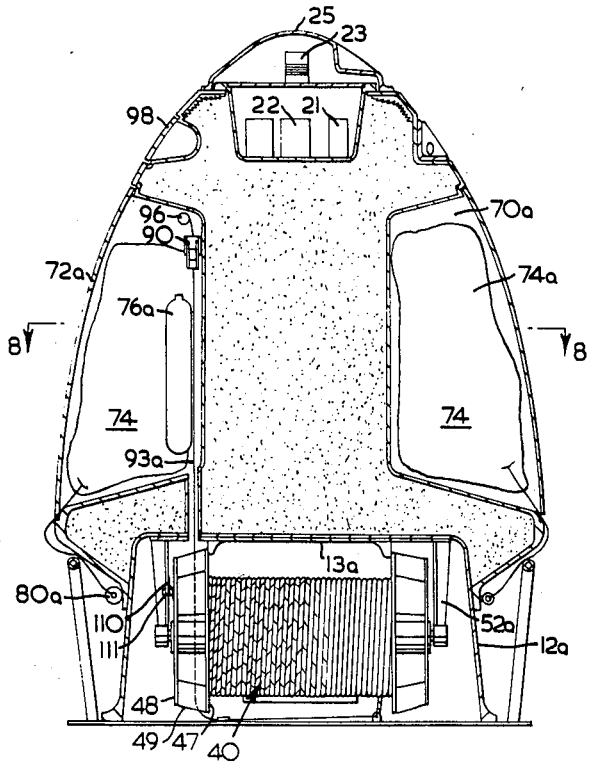
Figure 8:
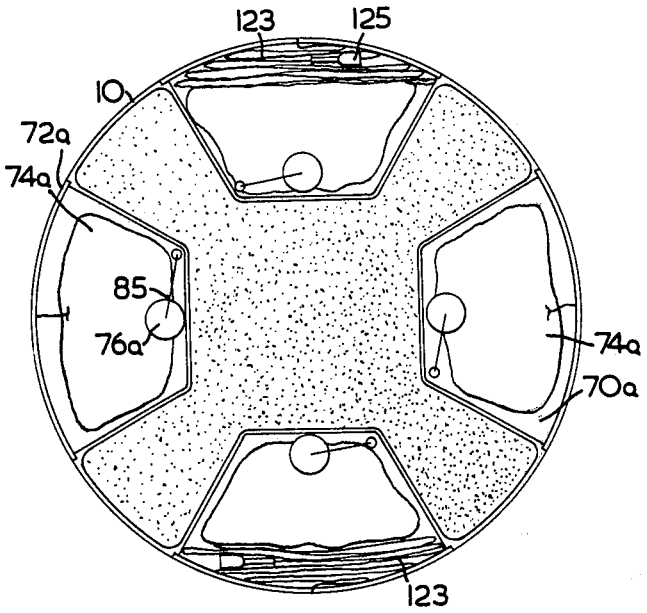

The invention will be more particularly described by way of example with reference to the accompanying drawings, in which:

FIG. 1 shows a side elevation of a first model of buoy,

FIG. 2 shows a sectional elevation on lines 2—2 of FIG. 1 and also shows in broken lines one of the life rafts being inflated, FIG. 3 shows a sectional elevation on lines 3—3 of FIG. 2, FIG. 4 shows a cross-sectional view on lines 4—4 of FIG. 2, FIG. 5 shows a further cross-sectional view on lines 5—5 of FIG. 2, FIG. 6 shows an elevation of a second model of buoy along with a launching davit, FIG. 7 shows a sectional elevation on lines 7—7 of FIG. 6, and FIG. 8 shows a cross-sectional view on lines 8—8 of FIG. 7.

The model of buoy shown in FIGS. 1-5 is intended for use on relatively small vessels. The buoy is circular in plan view, and the main body part is constituted by a casing 10 formed of glass fiber reinforced plastic having rounded and upwardly converging sides as shown in FIG. 1. The whole upper part of the buoy is painted or impregnated with bright orange paint. The lower part of casing 10 converges downwardly and terminates in a flange 11 which receives the generally cylindrical side walls of aluminum reel housing 12 including a skirt portion and a top plate 13 recessed inside the buoy body, and having a thickened lower rim 14 forming the lowest surface of the buoy. As will be clear from FIG. 2, the body also has recesses in two opposite sides thereof, and in the top, for purposes to be described. The casing 10 is filled with rigid closed pore urethane foam 15, which is foamed in place in the casing, and which provides buoyancy even if the casing 10 is punctured or otherwise damaged.

The lower rim 14 of the reel housing normally rests on a ¼ inch thick metal plate 16 which forms the base of a seating mount secured to the vessel. A suitable gasket is installed between the reel housing and the base of the seating mount. The seating mount includes four upstanding columns 17 holding a horizontal circular rail 18, all of galvanized steel or aluminum tubing. Rail 18 engages and supports the buoy body at the downwardly converging lower sides thereof, and rubber wedges are inserted between the rail and the buoy to hold the buoy firmly. However, the manner in which the buoy is supported by the rail 18, well below its center of buoyancy and on a downwardly converging surface of the buoy, ensures that the buoy will always release easily if the vessel sinks suddenly. The outer margin of the plate 16, outside the rim 14, is provided with a strong eye 19 (shown in FIG. 5) to which a buoy anchoring cable (described below) is attached, and a smaller eye 19a for a trip line.

The top recess of the buoy body contains an electronics canister 20 which is itself completely sealed against the ingress of moisture, and which can be removed intact from the buoy for servicing. The electronics canister contains a radio transmitter 21, and batteries 22 which are preferably lithium type or alkaline magnesium batteries which operate both the transmitter 21 and a strobe light 23 mounted in the top area of the canister. The strobe light is of the high intensity xenon type as used on aircraft for collision avoidance. The strobe light is connected to a solid state driving circuit also within the canister 20 which causes the light to produce ten flashes per minute with a peak intensity above 1 million foot candles. By the use of a Fresnel lens, the range of this light is between 15 and 25 miles under average conditions and greater in a clear atmosphere. The light 23 is covered by a Lucite dome 25, sealed around the upper surface of the casing 10, and having a recess 26 in which are disposed control switches 28 and the base mounting of an antenna 29. The radio 21 is connected to the antenna 29 and when activated produces distress and homing signals approved under international regulations. The switches 28 can either be used for manual operation of the radio and/or strobe light, for example when it is desired to send out a distress signal when the buoy is still on the vessel, and can also be used for periodic routine testing of the radio and light.

The radio transmitter and strobe light are both connected to a magnetically operated switch within the body of the buoy. The switch is completely enclosed against ingress of moisture, and is positioned to be externally operated by a magnet fixed to the upper rail 18 of the seating mount or to the base thereof. The magnet normally holds the switch in the "off" position, but when the buoy is removed from the mount (either by being launched or floating free) the switch is separated from the magnet, and a spring force then moves the switch to the "on" position to activate the transmitter and strobe light.

Disposed in an upper part of the buoy body is an internal radar reflector formed by reflective material 31, shown in FIG. 3, and which gives 360° coverage.

Spaced around the periphery of the body 10, close to the Lucite dome, are four recesses containing stainless steel lugs 33 which are welded to plates extending along the bottoms of the recesses, and firmly fixed to the plates inside the casing 10. These lugs include a relatively large aperture for receiving lifting hooks of a davit mounted near the buoy and by which the buoy is normally launched. This davit is similar to that shown in FIG. 6. The lugs also have small apertures which receive lines 35 which act both as lifelines for being grasped by survivors and as temporary mooring rails for buoyant equipment. The lifelines are of polypropylene rope with nylon covered cable threaded therethrough and which are extremely strong, so that these lifelines are the equivalent of mooring rails used on the buoy of the aforesaid patent. Furthermore, the lugs 33 are streamlined to follow the outer contours of the casing 10, and in addition the lifelines 35 are taped into place against the casing 10, although releasable therefrom when grasped by a survivor, and both of these factors combine to ensure that the lifelines and lugs cannot become entangled with any of the vessel's rigging in cases of rapid sinking when the buoy floats off the vessel.

The housing 12 provides a normally sealed enclosure for a cable reel 40 comprising a spindle 42 carrying a 3000 foot length of 3/16 inch galvanized steel anchoring cable 43 having its outer end led out through a notch in the underside of reel housing 13 and connected by quick release shackle 44 to eye 19. Spindle 42 has at each end a pair of plates 47 and 48, and is carried by journal bearings at the lower ends of support members 52. The end plates 47 and 48 carry in the space between them a series of paddles or vanes 49 and set at 45° to each other which, in addition to providing stiffening of the plates, serve during rotation of the reel as brakes since, once the buoy has been launched, and with the reel being rotated rapidly in the restricted space of housing 12 by the anchor cable 43 being paid out from the reel, these paddles churn the water and provide appreciable braking to offset possible override of the cable, particularly in case of failure of a friction brake. This friction brake comprises a spring element held by one of the supports 52 and acting on the outer side of the adjacent plate 60 to retard its rotation; this is similar to the friction brake shown in FIG. 7 and described below.

As shown in FIG. 3, the sides of the housing 12 on each side of the cable reel include canisters 62 and 63, one of which contains fluoresceine dye and shark repellent, and the other of which contains calming oil. Each canister has an outlet closed by a plug 64, these plugs being connected by short lines to the adjacent column 17 of the seating mount, in such manner that when the buoy leaves the seating mount the plugs are removed from the canisters and allow the dye, shark repellent and calming oil to seep from the canisters. The canister outlets are near to the top thereof and in a submerged position when the buoy is floating, so that the contents of the canisters mix gradually with the water in which the buoy is floating and leak out gradually from the canisters.

The weight of the cable and reel and associated parts, relative to the remainder of the buoy, are such that this floats substantially upright as shown. Two recesses 70 are provided in the buoy body each situated on a surface of the body which forms a side with the buoy upright, the recesses being on opposite sides of the central axis of the buoy, as shown in FIGS. 2 and 4, and as seen in FIG. 4 these recesses occupy slightly more than half the cross-sectional area of the buoy. Each recess is surrounded on all of its sides by the buoyant material of the buoy, and has a flat rear wall, and side walls which, as shown in FIG. 4, diverge towards the opening in the side of the buoy. As seen in FIGS. 2 and 4, the rigid buoyant material provides a solid column structure connecting the upper and lower parts of the buoy above and below the recesses 70. As will be clear from FIG. 2, the upper and lower walls of the recesses also diverge slightly towards the opening, and the lower wall slopes downwardly, outwardly towards the opening, the recesses thus having a maximum cross-sectional area at the opening, and also being free from protuberances which could hinder deployment of the raft. In this embodiment, which has an overall body height of 53 inches, each recess is rectangular in the plane of its opening and has a mean height of 24 inches, a means width of 19 inches, and a depth of 12 inches, giving about 3 cubic foot of space. Each recess is closed by a cover or door 72, these being rectangular and curved to conform with the body shape, and the edges of which fit within small rebates extending around the margins of the recess.

The design of the buoy, as to amount of buoyant material relative to weight, is such that when the buoy is initially launched and with covers 72 in place, the buoy floats with the water level near the bottom of the recesses 70. After the life rafts have been launched, and with the covers jettisoned, the buoy floats with the water level close to the top of the recesses.

The covers are held in place with marine, self adhesive sealing tape 73 applied to the outer surface of the cover and the adjacent part of the body 10, this tape being such as to prevent the ingress of moisture into the recesses, and providing a rupturable seal for a purpose to be described. The sealing tape 73 is wide enough to bridge the joint between the cover 72 and adjacent parts of the buoy body, i.e. the tape has one edge portion attached to the outer margin of the cover and a second edge portion attached to the part of the body surrounding recess 70. A single thickness of tape is applied all around the periphery of cover 72, and a double thickness of double width tape 73a is applied fully across the top margin of the cover and along the upper third of each of the side margins of the cover so that this double taping extends around the periphery of the top one-third of the cover and overlaps the narrower tape on both sides of the latter by at least ½ inch. The tape is such as to maintain a hinged connection with the top of the cover after rupture of the remaining tape occurs by inflation of the life raft, and furthermore the tape at the upper ends of the side margins resists outward hinging of the cover for a purpose to be described.

Each recess 70 accommodates a deflated life raft 74, which is stowed along with a cylinder 76 of pressurized gas (carbon dioxide or air) and which forms a part of standard inflatable life raft packages. As shown in FIG. 2, each cylinder 76 lies against the rear wall of the respective recess, and has its lower end seated upon the lower wall of the recess. The pressurized gas is releasable into the life rafts by valve means; the latter term however will be understood as meaning any kind of device operable to normally close the compressed gas cylinder but to allow this gas to be released into the life raft when required. An inflatable life raft of light weight marine type can be accommodated in each of the recesses 70; such rafts can be of various capacities including 4,6,10,16,24,32 and 40 person capacities.

The life rafts are each provided with painters one of which is 75 feet long and the other of which is 100 feet long, the outer ends of which are fixed to stainless steel pennants 78 which are 3 feet in length, and which leave the recesses 70 via a small notch 79 in the bottom of the covers 72, being taken down the lower part of the buoy body 10, under the support rail 18, and being fixed to an eye bolt 80 strongly secured to the lower rim of the body 10 and to a reinforced portion of the reel housing 12.

The notches 79 large enough to accommodate the pennants 78 will also allow for drainage of any moisture which may collect in the recesses 70 by reason to sweating of the life rafts. The fact that the recesses are upwardly elongated as shown, and have convenient drainage from their lowest point, ameliorates the common problem of stored life rafts becoming soggy and mildewed when stowed in conventional canisters.

Another feature of the invention is a restraining cord 81 which extends from eye bolt 80 to the central bottom portion of the life raft adjacent the centre of the gas cylinder 76. This assists in holding the inflating life raft in upright condition and is of suitable strength to break just before the life raft is fully launched.

The pressurized gas within each cylinder 76 is releasable into the associated life raft 72 by valve means is an operating head on the cylinder, the valve means being operable by a predetermined tension applied to a pull cable 85, this being a usual type of life raft inflating device. Suitable devices are manufactured by Walter Kidde Inc. of N.J., U.S.A. The pull cable 85 is led over pulleys 86 and 87 supported within the recess 70, and the outer end of cable 85 rotatably supports a small travelling reel 90 which is vertically movable in an enclosed track indicated at 92 in a manner such as not to interfere with the stowed life raft. The reel 90 carries a 50 foot length of stainless steel trip line 93 having an inner end secured to the reel 90 and its main stowed length being wound on this reel, the reel being rotatable relatively freely so that the stowed length of the trip line can be pulled from the reel 90 at a tension much less than the predetermined tension required to operate the valve means. The outer end portion of line 93 is led down via pulley 94 at the lower end of track 92, and passes via a conduit 95 connecting the base of each recess 70 to the interior of reel housing 12, the trip line being finally secured by a snap hook to the eye **19*a*** so as to be releasable if desired.

The trip line 93 is provided with a weak link **93*a* near to that inner end which is fixed to the reel 90, this being arranged to break at a tension substantially greater than that required to be applied by the pull cable 85 to operate the valve means of cylinder 76**.

As best seen in FIGS. 2 and 4, one of the recesses 70 contains, in addition to its life raft, a life boat mooring line 123. This is a 200 foot length of polypropylene rope having a water activated light 125 at its outer end, and with several eyes, and floats spaced along its length. Although this is termed a life boat mooring line, it is of course suitable for holding any type of buoyant equipment as well as swimmers. The polypropylene rope is itself buoyant, but the floats render it more easy to see in darkness. The lamp 125 contains a silver-magnesium battery which has an indefinite shelf life and an operating life of 14 hours, and which allows the lamp to produce a steady white light visible for about 3 miles. The line 123 is loosely fleeted and stowed in the bottom of one of the recesses, near to the lower edge of the cover, being thus enclosed and protected from the weather, and the inner end of this line which is constituted by a stainless steel tag line **123*a* passes out of the base of the cover (in like manner to the life raft painter) and is fixed to one of the eye bolts 80** also used for the life raft painters.

In addition to the automatic operating means for the life raft constituted by the trip line 93 and associated parts, there is also provided a manually operable release means for the life rafts, most clearly shown in FIG. 3. Thus, a further pull cable 96 also passing over pulleys 86 and 87 is provided which passes out of the recess 70 and into a small recess 97 near to the upper corner of recess 70, this recess being closed by a cover 98 having a handle 99. The cable passes out of cover 98 and has an outer portion **96*a* releasably taped down one side of the buoy as shown in FIG. 1, terminating in a knob 96*b*. A stowed length of about 50 feet of the cable 96 is contained within the recess 97. With this arrangement, a person in the water can grasp knob 96*b* and pull the cover 98 away from the casing 10, until the stowed pull cable 96** is fully extended, whereupon the pull cable causes release of the pressurized gas into the associated life raft. Similar means are provided for each of the life rafts.

The buoy is preferably provided with its own launching davit mounted close to the seating mount and which will be installed on the vessel as a unit together with the seating mount and the buoy. The davit is closely similar to that shown in FIG. 6 and described with reference to that figure. In the large majority of sinkings which occur, there is adequate time to launch the buoy by means of the davit and hooks connected to the lifting lugs 33. In such manual launchings, the officer in charge will probably prefer manually controlled launching of the life rafts, and for this purpose will disconnect the snap hooks of the trip lines 93 from the eye **19*a*, and will then pull the knobs 96*b* so that portions 96*a* of the gas release pull cables 96 are ripped away from the buoy, these cables then being secured to the ship's rail so that the life rafts can be deployed as and when required. Once the buoy is lifted clear of the seating mount, the magnetic switch activates the radio transmitter 21 and the strobe light 23**, (if this has not already been done manually), so that the buoy begins to send out distress signals.

On the other hand, if the vessel sinks suddenly, the buoy floats away from the seating mount, the mount being designed so that even if the vessel capsizes the buoy is not held in position by the mount.

Assuming normal operation around continental shelves, the anchoring cable 43 remains attached to eye 19, so that as the buoy leaves the vessel the cable 43 pays out from the reel 40 causing this to rotate. Over running of the reel is prevented both by the friction brake described, and by the paddles 49 churning the water and acting as a brake. Also, separation of the buoy from the vessel causes the trip lines 93 to be gradually pulled off the travelling reels 90, with little tension being applied at this stage to the pull cables 85. After the vessel has sunk by an appropriate depth (depending on the length of trip lines 93), all the stowed length of the trip line has been pulled off the reels 90, although the ends of the trip lines remain attached to these reels. Thus, further movement of the buoy causes the travelling reels 90 to move downwards in tracks 92, pulling the cables 85 over pulleys 86 and 87 and releasing the pressurized gas in cylinders 76 into the inflatable life rafts. Trip lines 93 then break at their weak links and do not impede further separation of buoy and vessel. The life rafts then start to inflate, and in doing so dislodge the covers 72, firstly breaking the single layer of tape 73 which holds the lower two-thirds of each cover 72 onto the buoy. The double tape 73a along the top of each cover 72 maintains a hinged connection between the cover and buoy body, and the double tape along the upper sides of the cover provides resistance to outwards pivoting of the cover, so that, as indicated in FIG. 2, the cover maintains contact with the upper side of the inflating life raft as this leaves the recess. The position of the heavy gas cylinder 76 in the recess, together with the downwardly sloping lower wall, ensures that the cylinder 76 slides from the stowed position near the rear wall to an intermediate position shown in broken lines in FIG. 2 and then to its final position on the bottom of the life raft. The cover 72, by maintaining contact with the top of the inflating raft, and the cord 81, prevent the raft from being upset by wind and waves during its inflation, and and whole arrangement is designed to ensure proper launching of the life rafts and to minimize or eliminate the change of inverted inflation.

The cord 81 breaks before final launching. The covers 72 may remain attached to the buoy in a calm sea, but in a rough sea will break away and sink.

After launching, the life rafts remain connected to the buoy by their painters and pennants 78, lying one behind the other by virtue of the unequal length of these painters. The deployment of the life rafts in this manner causes the lifeboat mooring line 123 to be dislodged, and this then streams out on the water while remaining attached to the buoy by eye bolt 80. The mooring line, and also the lifeline 35 can easily be grasped by swimmers in the water, and the mooring line also serves as useful mooring means for life boats or life rafts other than those carried by the buoy. In this manner, the life rafts, life boats etc. are held in a marshalled, head to weather condition, prevented from drifting by the anchoring cable 43 attached to the vessel, and easily locatable by the radio, radar reflector and light beacon means.

When the vessel is operating in depths greater than 3000 feet (the length of the anchor cable), it will be standard procedure to release the shackle 44 of cable 43 from the eye bolt 19, preventing any possibility of the buoy being dragged down by the sinking vessel. Although not connected to the vessel, the buoy will nevertheless limit the drifting of the buoyant equipment since it acts as a good sea anchor, due to the turbulence of the water in the skirt 12 and in the empty recesses 70, which water reaches close to the top of the recesses. It has been calculated, for example, that a buoy of this kind, attached to one 10 man life raft and one 26 foot life boat, will drift at only about 3 knots in a 20 knot wind. On the ocean, this amount of drifting is unlikely to give rise to any danger. The low speed of drift will closely approximate that of survivors in the sea. The weight of cable 43 on the reel also slows the drift and adds stability. The attachment of the mooring line 123 and the life raft painters to the reel housing, i.e. near the base of the buoy, ensures that tension on these lines does not unduly tilt the buoy in a way which would interfere with emission of radio and light signals.

The length of trip line 93 is selected such as to preclude release of the rafts until the buoy has cleared the vessel's rigging. Instead of the stowed length of trip line being carried by a travelling reel on the buoy, this may be carried by a reel fixed to the buoy seating mount.

Instead of having the outer end of anchor cable 43 connected to eye 19 by a quick release shackle and having this disconnected for deep-sea voyages, the connection of the cable to the vessel may be by means of a small hydrostatically controlled release. Such releases are available to operate at tolerances of 50 feet of depth, and could be set to release the outer end of anchor cable 43 at a depth of say 50 feet less than the total length of the cable, to preclude the possibility of the buoy being dragged down by its cable.

FIGS. 6, 7 and 8 show a second embodiment of buoy generally similar to that just described, but suitable for use on larger vessels. The buoy body is similarly constructed of a molded fiberglass reinforced plastics casing surrounding urethane foam, although the body is larger, the buoy having an overall height of 90 inches and a correspondingly larger diameter.

Most of the features of this second embodiment are similar to those of the first embodiment, and corresponding features are indicated by the reference numerals used for the first embodiment. The main difference in these embodiments, except for the size, is that in this second embodiment the buoy body is provided with four recesses **70*a* spaced around the sides, each of these having outwardly sloping sides (as shown in FIG. 8) and each being surrounded on all its sides by the buoyant foam material. Each of the recesses 70*a* contains an inflatible life raft 74*a*, each associated with a pressurized gas cylinder 76*a*, each of these life rafts being of light weight marine type and suitable for accommodating 40 men. The life rafts are connected by painters of unequal length, for example 50 feet, 75 feet, 100 feet, and 125 feet, to eye bolts 80*a* on the reel housing 12. The recesses are closed by covers 72*a***, which again are sealed by tape to the casing of the buoy body the tape being distributed in such manner that the seal can be ruptured by inflation of the life rafts, which expel themselves onto the water while being steadied by the covers which initially remain hinged to the top of the recess in the buoy body.

FIG. 7 shows further friction brake means additional to the brake means constituted by vanes 49, provided by a spring metal element 110 attached at one end to one of the supports **52*a* and having its other end portion pressed against the outer face of an outer plate 48 by an adjustable screw 111. The main part of the reel between plates 47 carries a 5000 foot length of 5/16 inch diameter galvanized steel wire cable, the outer end of which is lead through a suitable notch provided in the bottom rim of reel housing 12*a***, and connected to a snap hook or quick slip shackle which is removably connected to an eye bolt carried by the base of the seating mount just outside the reel housing.

Each of the life rafts is inflatable by manual release means connected to a cable **96*a*, as in the first embodiment, as well as by the trip lines 93*a* which pass from the buoy body into skirt 12*a*** and from there pass to eyes on the base plate just outside the skirt.

In this embodiment, two buoyant life boat mooring lines 123 are provided, mounted as shown in FIG. 8 in the outside lower corners of two opposite recesses **70*a***. One of these mooring lines is 200 feet in length, and the other is 250 feet in length, so that life boats secured thereto will not clash with each other. Each of the mooring lines includes a water activated light, and readily visible floats, as described with reference to the first embodiment.

FIG. 6 of the drawings shows, in addition to the buoy, a launching davit 126, swingable about a vertical pivot held by support 27. The hook 128 of the davit is liftable by a manually operated winch 129.

Other features of this embodiment of buoy, such as the light and radio beacon means, the radar reflector and the general nature of the base support, and the manner of operation of the buoy, are all similar to what was described above with reference to FIGS. 1 to 5, and therefore will not further be described.

If the vessel carrying the buoy is to be used in Arctic conditions, then the seating mount may be enclosed with stainless steel sheeting, and the enclosed area may be electrically heated to avoid icing up.

As an alternative to the use of tapes for holding the removable covers 72, 72*a* in place, magnetic materials may be embedded in these covers and in the associated body parts for removably holding the covers.

For larger vessels, a buoy having more than four life raft recesses may be provided. In such buoys, and in fact in a fourraft buoy, the recesses may be arranged side by side around a central column of buoyant material. In such arrangements, the buoyant material would surround the top, rear and bottom of each recess but not the sides.

The inventor does not recommend that buoyant life saving equipment now carried by ships be reduced by reason of the installation of any model of the buoys he has invented. These buoys should be used in addition to all life saving equipment now in vogue. It has been his experience during over fifty years of life closely associated with the sea, that in sinkings by any cause at sea there is invariably insufficient buoyant life saving equipment available from one cause or another.

In addition to the life saving capabilities, the buoys described above also assist in the following functions:

1. Preventing pollution for example from oil tankers by giving immediately the location of a sinking vessel.

2. Instant wreck marking, thus ensuring that there is no collision between a surface vessel and a sunken vessel. This has frequently occurred in crowded waters. Also, fast and accurate installation of permanent wreck markers is facilitated.

3. Marine salvage. The buoys operate as mooring points for salvage vessels, and the anchoring cable serves as a "shot line" for divers.

4. Fire fighting. The buoy may be equipped with fire fighting equipment usable against ship fires.

I claim:

1. Life saving apparatus for vessels comprising a buoy suitable for being carried by a vessel in a manner providing automatic release and flotation of the buoy should the vessel sink, said buoy including a body having sufficient buoyancy to cause the buoy and parts carried thereby to float free from the sinking vessel, a cable of adequate strength to act as an anchor cable connected with the buoy and for connection with the vessel so as to maintain connection between the floating buoy and the vessel after the vessel has sunk, wherein the buoy includes a casing filled with rigid buoyant material imparting strength to the body of the buoy, said anchor cable being connected to a lower part of the buoy so that when the buoy is floating the weight of the cable and relative weights of the remaining parts of the buoy hold the buoy upright with the anchor cable extending from its lower end, said body having at least one recess therein opening into that surface of the body which is at the side when the buoy is floating upright, said recess having outwardly sloping side surfaces and being surrounded by said rigid buoyant material which forms a solid structure connecting the upper and lower parts of the buoy above and below said recess, said recess being normally closed by a cover which forms an enclosure with said recess, an inflatable life raft normally stowed in deflated condition in said enclosure together with a source of pressurized gas for inflating said life raft, said source of pressurized gas communicating with valve means controlling flow of gas into the life raft for its inflation, said valve means being operable by release means extending out of said enclosure, said cover of the recess being joined to the buoy body by holding means which holding means are so arranged as to permit the life raft to dislodge said cover and to expel itself from said enclosure during its inflation, whereby said valve means are operable from outside the enclosure to cause the life raft to inflate and expel itself from the buoy.

2. Life saving apparatus according to claim 1, wherein said anchor cable is normally stowed on a reel held by the buoy.

3. Life saving apparatus according to claim 1, wherein said life raft has a painter secured to the buoy at all times which painter is many times the length of the maximum dimension of the buoy whereby the inflated life raft remains connected to the buoy by said painter after inflation and after expelling itself from the buoy.

4. Life saving apparatus according to claim 3, wherein a drainage hole is provided leading from the lowest point in the life raft recess to the outside of the buoy.

5. Life saving apparatus according to claim 1 wherein said recess is one of at least two recesses provided in opposite sides of the buoy body, each recess being provided with a said cover forming an enclosure which houses a said inflatable life raft, and each of said recesses being shaped to allow the life raft therein to expel itself when being inflated, said life rafts being connected to the buoy by painters of differing length.

6. Life saving apparatus according to claim 1, wherein there are provided means suitable for interconnecting the valve means and the vessel when the buoy is installed on a vessel, said interconnecting means being arranged to cause inflation of said inflatable life raft automatically after separation of the buoy from the vessel by a predetermined amount.

7. Life saving apparatus according to claim 6, wherein said means suitable for interconnecting the valve means and the vessel includes a trip line normally stowed on the buoy which causes operation of the valve means to inflate the life raft when pulled out from a stowed position, and means are provided for forming an interconnection between said trip line and the vessel.

8. Life saving apparatus according to claim 7, wherein said trip line has one end connected to said valve means, and has its other end directly connected to a fixed point on the vessel, and having its stowed length held in such manner as to be pulled out to its full length before the trip line subjects the valve means to sufficient force to inflate the life raft.

9. Life saving apparatus according to claim 1, wherein a breakable cord is provided connecting the lower part of the raft to the buoy body in the region of the bottom of the recess, said cord being of suitable strength for assisting in holding the raft in proper orientation during inflation and being such as to break prior to full inflation of the raft.

10. Life saving apparatus according to claim 1, wherein the buoyancy of the buoy is such that when said life raft has been expelled from said recess a substantial proportion of said recess is submerged, so that when said buoy is pulled through the water as by a life raft turbulence is produced in said recess so that the resistance to movement of the buoy in the water is enhanced.

11. Life saving apparatus for vessels having a rigging comprising a buoy suitable for being carried by a vessel in a manner providing for automatic release and flotation of the buoy should the vessel sink, said buoy including a body having sufficient buoyancy to cause the buoy and parts carried thereby to float free from the sinking vessel, a normally stowed cable of adequate strength to act as an anchor cable connected with the buoy and for connection with the vessel so as to be capable of maintaining connection between the floating buoy and the vessel after the vessel has sunk, said body including a casing filled with rigid buoyant material imparting strength to the body of the buoy, said anchor cable being connected to a lower part of the buoy so that when the buoy is floating the weight of the cable and relative weights of the remaining parts of the buoy hold the buoy upright with the anchor cable extending from its lower end, said body having at least one recess therein opening into that surface of the body which is at the side when the buoy is floating upright, said recess having outwardly sloping side surfaces free from protuberances and said recess being surrounded by said rigid buoyant material, which rigid material forms a solid structure connecting the upper and lower parts of the buoy above and below said recess, said recess being normally closed by a cover which forms an enclosure with said recess, an inflatable life raft normally stored in deflated condition in said enclosure together with a source of pressurized gas for inflating said life raft, said source of pressurized gas communicating with valve means controlling flow of said gas into the life raft for its inflation, said valve means being operable by release means extending out of said enclosure, said release means including a normally stowed trip line which causes operation of the valve means to inflate the life raft when fully pulled out from a stowed position, said trip line being arranged to be pulled from its stowed position when the buoy separates from the vessel and having a stowed length sufficient to allow the vessel to sink by a predetermined amount sufficient for said vessel's rigging to be fully submerged before the trip line is fully pulled from its stowed position to inflate the life raft; said cover of the recess being joined to the buoy body by holding means, said holding means so arranged as to permit the life raft to dislodge said cover and to expel itself from said enclosure during its inflation, said life raft having a painter secured to the buoy at all times including when the raft is defined, which painter is many times the length of the maximum dimension of the buoy, whereby on a sudden sinking of the vessel said buoy remains on the surface of the water and, as the vessel sinks, said trip line is pulled from its stowed position until after the vessel's rigging has become submerged when the life raft is inflated and expels itself from said enclosure, remaining connected to said buoy by said painter at a safe distance therefrom.

12. Life saving apparatus for vessels comprising a buoy suitable for being carried by a vessel in a manner providing automatic release and flotation of the buoy should the vessel sink, said buoy including a body having sufficient buoyancy to cause the buoy and parts carried thereby to float free from the sinking vessel, a cable of adequate strength to act as an anchor cable connected with the buoy and for connection with the vessel so as to maintain connection between the floating buoy and the vessel after the vessel has sunk, said anchor cable being connected to a lower part of the buoy so that when the buoy is floating the weight of the cable and relative weights of the remaining parts of the buoy hold the buoy upright with the anchor cable extending from its lower end, said body having at least one recess therein opening into that surface of the body which is at the side when the buoy is floating upright, said recess being normally closed by a cover which forms an enclosure with said recess, an inflatable life raft normally stowed in deflated condition in said enclosure together with a source of pressurized gas for inflating said life raft, and valve means controlling flow of gas from said source into the life raft for its inflation, said cover of the recess being joined to the buoy body by holding means, said holding means being so arranged and said recess being so shaped as to permit the life raft to dislodge said cover and to expel itself from said enclosure during its inflation, said valve means being operable from outside the enclosure to cause the life raft to inflate and expel itself from the buoy, said holding means having a strength distribution which ensures that an upper part thereof maintains hinged connection between an upper part of the cover and the buoy body after the remainder of the holding means has been caused to release the remainder of the cover by initial inflation of the life raft, said upper part of the holding means being such as to restrain outward pivoting of the cover about said connection during initial inflation of the life raft, whereby the cover remains in contact with an upper part of the life raft and steadies the latter as it expels itself from the recess.

13. Life saving apparatus according to claim 12, wherein said life raft is stowed in said recess with said source of pressurized gas adjacent the rear wall of said recess.

14. Life saving apparatus according to claim 12, wherein said recess has a downwardly, outwardly sloping lower wall.

15. Life saving apparatus according to claim 12, wherein said holding means comprises tape means which has one edge portion attached to the outer margin of the cover and a second edge portion attached to the part of the buoy body surrounding the recess, and wherein said tape means comprising said upper part of the holding means is thicker than the remaining tape means.

16. Life saving apparatus according to claim 15, wherein said upper part of the holding means comprises a double layer of tape and said remaining holding means comprises a single layer of tape.

17. Life saving apparatus according to claim 15, wherein said thicker tape means extends around the periphery of approximately the upper third of the cover.

18. Life saving apparatus according to claim 15, wherein said cover is substantially rectangular, and wherein said thicker tape means extends fully across the upper margin of said cover and along a minor, upper portion of each of the side margins of the cover.

19. Life Saving apparatus for vessels comprising a buoy suitable for being carried by a vessel in a manner providing automatic release and flotation of the buoy should the vessel sink, said buoy including a body having sufficient buoyancy to cause the buoy and parts carried thereby to float free from the sinking vessel, a cable of adequate strength to act as an anchor cable connected with the buoy and for connection with the vessel so as to maintain connection between the floating buoy and the vessel after the vessel has sunk, said anchor cable being connected to a lower part of the buoy so that when the buoy is floating the weight of the cable and relative weights of the remaining parts of the buoy hold the buoy upright with the anchor cable extending from its lower end, said body having at least one recess therein opening into that surface of the body which is at the side when the buoy is floating upright, said recess being normally closed by a cover which forms an enclosure with said recess, said recess having a height approximately twice the maximum depth, and having a downwardly outwardly sloping bottom wall, and wherein a drainage hole is provided at the junction of adjacent parts of the buoy body and cover by the provision of a notch in one of said adjacent parts, said drainage hole leading from the lowest part of the recess to the outside of the buoy, said buoy also including an inflatable life raft normally stowed in deflated condition in said enclosure together with a source of pressurized gas for inflating said life raft.

20. Life saving apparatus for vessels comprising a buoy suitable for being carried by a vessel in a manner providing automatic release and flotation of the buoy should the vessel sink, said buoy including a body having sufficient buoyancy to cause the buoy and parts carried thereby to float free from the sinking vessel, a cable of adequate strength to act as an anchor cable connected with the buoy and for connection with the vessel so as to maintain connection between the floating buoy and the vessel after the vessel has sunk, said anchor cable being connected to a lower part of the buoy so that when the buoy is floating the weight of the cable and relative weights of the remaining parts of the buoy hold the buoy upright with the anchor cable extending from its lower end, said body having at least one recess therein opening into that surface of the body which is at the side when the buoy is floating upright, said recess being normally closed by a cover which forms an enclosure with said recess, said recess having a downwardly outwardly sloping bottom wall, an inflatable life raft normally stowed in deflated condition in said enclosure together with a source of pressurized gas for inflating said life raft, and wherein a drainage hole is provided leading from the lowest point of the life raft recess to the outside of the buoy and wherein said life raft has a painter secured to the buoy at all times which painter is many times the maximum dimension of the buoy, said painter having an end secured to the buoy at a fixing point below said recess, said drainage hole being suitable for allowing the painter to pass from said fixing point to the life raft when the latter is stowed in the recess.

21. Life saving apparatus for vessels comprising a buoy suitable for being carried by a vessel in a manner providing automatic release and flotation of the buoy should the vessel sink, said buoy including a body having sufficient buoyancy to cause the buoy and parts carried thereby to float free from the sinking vessel, a cable of adequate strength to act as an anchor cable connected with the buoy and for connection with the vessel so as to maintain connection between the floating buoy and the vessel after the vessel has sunk, said anchor cable being connected to a lower part of the buoy so that when the buoy is floating the weight of the cable and relative weights of the remaining parts of the buoy hold the buoy upright with the anchor cable extending from its lower end, said body having at least one recess therein opening into that surface of the body which is at the side when the buoy is floating upright, said recess being normally closed by a cover which forms an enclosure with said recess, an inflatable life raft normally stowed is deflated condition in said enclosure together with a source of pressurized gas for inflating said life raft, and wherein the buoyancy of the buoy is such that when said life raft has been expelled from said recess a substantial proportion of said recess is submerged, so that when said buoy is pulled through the water as by a life raft turbulence is produced in said recess so that the resistance to movement of the buoy in the water is enhanced.

22. Life saving apparatus according to claim 21, wherein said recess is one of at least two recesses spaced around the buoy body, each recess being provided with a cover forming an enclosure which houses a said inflatable life raft, and wherein the buoyancy of the buoy is such that with the buoy floating and the recesses uncovered and empty, the water covers the major proportion of the depth of the recesses.

23. Life saving apparatus according to claim 22, wherein the buoyancy is such that when the buoy is floating and the recesses uncovered and empty, said recesses are substantially submerged.

24. Life saving apparatus according to claim 21, wherein said buoy is provided with a life boat mooring line which is released from the buoy after the buoy has separated from the vessel, said mooring line being suitable for attachment of buoyant equipment thereto.

25. Life saving apparatus for vessels comprising a buoy suitable for being carried by a vessel in a manner providing automatic release and flotation of the buoy should the vessel sink, said buoy including a body having sufficient buoyancy to cause the buoy and parts carried thereby to float free from the sinking vessel, a cable of adequate strength to act as an anchor cable connected with the buoy and for connection with the vessel so as to maintain connection between the floating buoy and the vessel after the vessel has sunk, wherein the buoy includes a casing filled with rigid buoyant material imparting strength to the body of the buoy, said anchor cable being connected to a lower part of the buoy so that when the buoy is floating the weight of the cable and relative weights of the remaining parts of the buoy hold the buoy upright with the anchor cable extending from its lower end, said body having at least four recesses therein opening into that surface of the body which is at the side when the buoy is floating upright, said recesses having outwardly sloping side surfaces and surrounding a central column of said rigid buoyant material which forms a solid structure connecting the upper and lower parts of the buoy above and below said recesses, each recess being normally closed by a cover which forms an enclosure with said recess, an inflatable life raft normally stowed in deflated condition in each said enclosure together with a source of pressurized gas for inflating said life raft, said source of pressurized gas communicating with valve means controlling flow of gas into the life raft for its inflation, said valve means being operable by release means extending out of said enclosure, said cover of the recess being joined to the buoy body by holding means which holding means are so arranged as to permit the life raft to dislodge said cover and to expel itself from said enclosure during its inflation, whereby said valve means are operable from outside the enclosure to cause the life raft to inflate and expel itself from the buoy.

26. Life saving apparatus for vessels comprising a buoy suitable for being carried by a vessel in a manner providing automatic release and flotation of the buoy should the vessel sink, said buoy including a body having sufficient buoyancy to cause the buoy and parts carried thereby to float free from the sinking vessel, wherein the buoy includes a casing filled with rigid buoyant material imparting strength to the body of the buoy, said body having at least four recesses therein opening into opposing surfaces of the body, said recesses having outwardly sloping side surfaces and surrounding a central column of said rigid buoyant material which forms a solid structure connecting the upper and lower parts of the buoy above and below said recesses, the weight of said buoy and parts carried thereby being distributed so that when the buoy is floating said central column is upright, each recess being normally closed by a cover which forms an enclosure with said recess, an inflatable life raft normally stowed in deflated condition in each said enclosure together with a source of pressurized gas for inflating said life raft, said source of pressurized gas communicating with valve means controlling flow of gas into the life raft for its inflation, said valve means being operable by release means extending out of said enclosure, said cover of the recess being joined to the buoy body by holding means which holding means are so arranged as to permit the life raft to dislodge said cover to expel itself from said enclosure during its inflation, whereby said valve means are operable from outside the enclosure to cause the life raft to inflate and expel itself from the buoy.

27. Life saving apparatus according to claim 26, wherein said holding means have a strength distribution which ensures that an upper part thereof maintains hinged connection between an upper part of the cover and the buoy body after the remainder of the holding means has been caused to release the remainder of the cover by initial inflation of the life raft, said upper part of the holding means being such as to restrain outward pivoting of the cover about said connection during initial inflation of the life raft, whereby the cover remains in contact with an upper part of the life raft and steadies the latter as it expels itself from the recess.

28. Life saving apparatus according to claim 26, wherein a drainage hole is provided leading from the lowest points in the life raft recess to the outside of the buoy.

29. Life saving apparatus according to claim 26, wherein the buoyancy of the buoy is such that when said life raft has been expelled from said recess a substantial proportion of said recess is submerged, so that when said buoy is pulled through the water as by a life raft turbulence is produced in said recess so that the resistance to movement of the buoy in the water is enhanced.

* * * * *